US007637252B2

(12) United States Patent
Jung et al.

(10) Patent No.: US 7,637,252 B2
(45) Date of Patent: Dec. 29, 2009

(54) COMMON RAIL INJECTION SYSTEM

(75) Inventors: Uwe Jung, Donau (DE); Janos Radeczky, Wensenbach (DE); Michael Wirkowski, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/750,160

(22) Filed: May 17, 2007

(65) Prior Publication Data

US 2007/0283930 A1 Dec. 13, 2007

(30) Foreign Application Priority Data

May 18, 2006 (DE) ..... 10 2006 023 470

(51) Int. Cl.
*F02M 63/00* (2006.01)

(52) U.S. Cl. ..... 123/447

(58) Field of Classification Search ..... 123/447, 123/446, 527, 27 GE, 299, 467; 239/96; 60/285

See application file for complete search history.

(56) References Cited

U.S. PATENT DOCUMENTS

| | | | | |
|---|---|---|---|---|
| 4,858,583 | A * | 8/1989 | Sonntag | 123/527 |
| 6,168,133 | B1 | 1/2001 | Heinz et al. | 251/57 |
| 6,672,279 | B2 * | 1/2004 | Nakayama et al. | 123/299 |
| 6,823,846 | B2 | 11/2004 | Mattes | 123/456 |
| 7,219,659 | B2 | 5/2007 | Magel et al. | 123/514 |
| 7,249,574 | B2 * | 7/2007 | Verstallen | 123/25 A |
| 2006/0169252 | A1 * | 8/2006 | Ludwig et al. | 123/447 |

FOREIGN PATENT DOCUMENTS

| | | |
|---|---|---|
| DE | 19743668 | 10/1997 |
| DE | 10218024 | 4/2002 |
| DE | 10248467 | 10/2002 |
| DE | 10335603 | 8/2003 |

* cited by examiner

*Primary Examiner*—Stephen K Cronin
*Assistant Examiner*—Keith Coleman
(74) *Attorney, Agent, or Firm*—King & Spalding L.L.P.

(57) ABSTRACT

A common rail injection system for an internal combustion engine has at least one combustion chamber, a high pressure fuel pump for supplying fuel, a high pressure fuel accumulator connected to the high pressure fuel pump for storing fuel $p_{inj}$ at injection pressure in relation to the environment of the common rail injection system, an injector connected to the high pressure fuel accumulator for delivering fuel into the at least one combustion chamber, and a return line for returning fuel from the injector to the high pressure fuel pump. The fuel is pressurized by a return line pressure $p_{drain}$ in relation to the environment of the common rail injection system. It is proposed that the common rail injection system has an adjusting means for adjusting the return line pressure $p_{drain}$. It is additionally proposed to use a pressure control means in the fuel leakage flow feedback system of an internal combustion engine.

17 Claims, 3 Drawing Sheets

COMMON RAIL INJECTION SYSTEM

CROSS-REFERENCE TO RELATED APPLICATIONS

This application claims priority from German Patent Application No. 10 2006 023 470.7, which was filed on May 18, 2006, and is incorporated herein by reference in its entirety.

TECHNICAL FIELD

The invention relates to a common rail injection system for an internal combustion engine.

BACKGROUND

Common rail injection systems of this type are known. The injectors used therein include an injector body and a switching means mounted in the injector body, said switching means having a closed and open position. In the open position of the closing body, the fuel passes through the injector into the combustion chamber of the internal combustion engine. In the closed position, the fuel supply into the combustion chamber is interrupted. A leakage flow is produced as a result of the manufacturing tolerances of the switching means, this means that injection-pressurized fuel creeps along between the switching means and its storage in the injector body and has to be removed therefrom so that the switching means remain actuatable.

The leakage flow means expending additional energy, since injection-pressurized fuel also has to be delivered even if the injector is closed.

SUMMARY

The leakage flow in a combustion engine can be reduced. According to an embodiment common rail injection system for an internal combustion engine having at least one combustion chamber, may comprise a high pressure fuel pump for supplying fuel, a high pressure fuel accumulator connected to the high pressure fuel pump for storing injection-pressurized fuel in relation to the environment of the common rail injection system, an injector connected to the high pressure fuel accumulator for delivering fuel into the at least one combustion chamber and a return line for returning fuel from the injector to the high pressure fuel pump said fuel being pressurized by a return line pressure in relation to the environment of the common rail injection system, and an adjusting means for adjusting the return line pressure.

BRIEF DESCRIPTION OF THE DRAWINGS

The invention is described below with reference to the drawings, in which.

DETAILED DESCRIPTION

Figure 1:
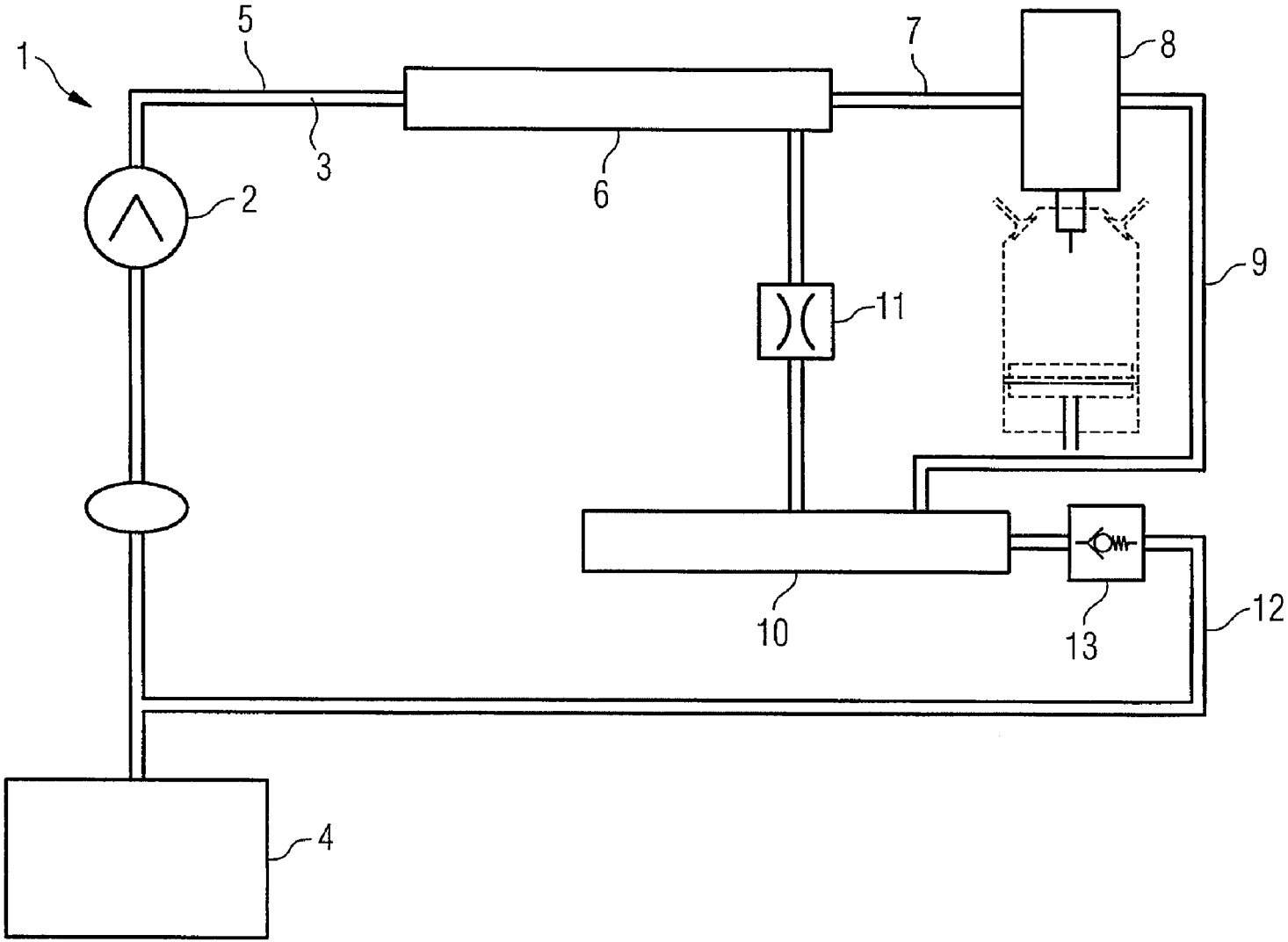
FIG. 1 shows a circuit diagram of a common rail injection system according to an embodiment.

According to different embodiments, a smaller leakage flow and an associated lower energy outlay during operation of the common rail injection system is provided.

This advantage is particularly significant if, in addition to the leakage flow, a switching leakage flow is produced. This is the case if the switching means is moved into the open and/or closed position with the aid of injection-pressurized fuel. The energy needed to open and/or close is then drawn from the injection-pressurized fuel. High injection pressures result in a considerable switching leakage flow and a significant power loss resulting therefrom, which results in the switching leakage flow having to be subject to the injection pressure again.

The adjusting means for adjusting the return line pressure causes the pressure difference Δp between the injection pressure $p_{inj}$ and the return line pressure $p_{drain}$ to reduce so that the switching leakage flow reduces. This reduces the leakage-specific power loss and increases the efficiency of the common rail injection system and thus an internal combustion engine, to which the common rail injection system is assigned.

A further advantage according to an embodiment is that it can be realized in a simple fashion. This also enables the retrofitting of existing common rail injection systems by installing an adjusting means, such as for instance a pressure control valve so that the return line pressure $p_{drain}$ can be adjusted.

It is also advantageous that lower forces and accelerations occur as a result of the reduced pressure difference Δp between the injection pressure $p_{inj}$ and the return line pressure $p_{drain}$ when opening or closing the injector. The wear of the injector is herewith reduced and its service life thus increased. In addition, the pressure difference Δp can be selected such that it is optimum for the operation of the injector, in other words an optimum compromise between a rapid opening and closing speed (with a high pressure difference Δp) and a high service life (with a low pressure difference Δp).

It is also advantageous that less heat is introduced into the fuel as a result of the lower leakage flow and/or switching leakage flow. The additional power to be applied by means of the leakage flow is namely essentially supplied to the fuel completely in the form of heat. In the case of a lower heat input, there is no need for the installation of expensive, heat-resistant leakage return lines or fuel coolers.

The lower leakage flow also allows the high pressure fuel pump to be dimensioned smaller, as a result of which weight and cost savings can be advantageously made.

It is also advantageous that the time taken for the injector to open and/or close is not dependent on the injection pressure $p_{inj}$ and thus does not need to be considered during the control of the injector.

A piston engine, in particular an Otto engine or a diesel engine is understood below as an internal combustion engine. Internal combustion engines of this type have a maximum power of in particular between 10 kW and 500 kW.

Fuel can be understood here in particular as Otto or diesel fuel, methanol, biodiesel, ethanol or vegetable oil.

The high pressure fuel pump is designed in particular to supply fuel with an injection pressure $p_{inj}$ of more than 80 MPa, in particular at least 140 MPa.

A high pressure fuel accumulator can be understood here to include anything that can contain pressurized fuel. In particular, a fuel line for connecting the high pressure fuel pump and the injector is also to be considered as a high pressure fuel accumulator.

In a preferred embodiment, the common rail injection system includes a buffer store in the return line. This evens out pressure points. The buffer store preferably has a volume of 1-20 cubic centimeters, in particular 5-15 cubic centimeters.

The adjusting means preferably includes a pressure control valve behind the injector. A pressure control valve of this type opens if the return line pressure exceeds a preset value. In an advantageous embodiment, the pressure control valve can be controlled electrically, so that the return line pressure $p_{drain}$ can be controlled by engine timing. In this case, "behind" always refers to the flow of fuel. This means that fuel coming from the high pressure fuel pump passes the injector first and only then passes the pressure control valve.

The pressure control valve is preferably arranged behind the buffer store. This guarantees that all the fuel available in the buffer store is below the return line pressure $p_{drain}$.

The pressure control valve is advantageously designed such that the pressure difference Δp formed from the injection pressure and return line pressure ($\Delta p = p_{inj} - p_{drain}$) is smaller than 50 MPa, in particular smaller than 40 MPa, in particular smaller than 30 MPa. The difference pressure Δp is advantageously greater than 5 MPa, in particular greater than 10 MPa, in particular greater than 15 MPa, in particular greater than 20 MPa.

A throttle valve is advantageously provided, which bypasses the injector and is connected to the return line upstream of the adjusting means. This results in the return line pressure developing very quickly when the internal combustion engine is started.

FIG. 1 shows a common rail injection system 1 for an internal combustion engine having at least one combustion chamber, which is depicted using a dashed line. The common rail injection system 1 includes a high pressure fuel pump 2 for supplying fuel 3 from a fuel tank 4. The high pressure fuel pump 2 is connected to a high pressure fuel accumulator 6 by way of a fuel line 5.

An injector 8 is connected to the high pressure fuel accumulator 6 by way of a fuel line 7. The injector 8 is connected to a buffer store 10 by way of a return line 9, said buffer store 10 being used to receive fuel which leaves the injector 8 as a result of a leakage and/or switching leakage.

A throttle valve 11 (capillary throttle or throttle diaphragm) is arranged between the high pressure fuel accumulator 6 and the buffer store 10, by means of which throttle valve 11 the fuel 3 can reach the buffer store 10 from the high pressure fuel accumulator 5 and the injector 8 is herewith bypassed.

The buffer store 10 is connected to the high pressure pump 2 by way of a further return line 12. A pressure control valve 13 is located in the return line 12. The fuel 3 in the buffer store 10 is pressurized by a return line pressure $p_{drain}$. The pressure control valve 13 is designed so that fuel can only escape from the buffer store 10 if the return line pressure $p_{drain}$ exceeds a predetermined value. This value amounts in the present case to 135 Mpa in relation to the environment of the common rail injection system 1 and 25 MPa in relation to the injection pressure $p_{inj}$.

During operation, the high pressure fuel pump 2 sucks fuel 3 from the fuel tank 4 and compresses it into an injection pressure $p_{inj}$, which lies at a maximum of 160 Mpa in relation to the environment of the common rail injection system 1. The pressurized fuel reaches the high pressure fuel accumulator 6 and from there the injector 8. As a result of control signals of an engine timing (not illustrated), the injector 8 opens and closes and herewith delivers fuel 3 to a combustion chamber of the internal combustion engine (shown here with a dashed line). The fuel of the leakage flow reaches the buffer store 10 through the pressure line 9 and from there back to the high pressure fuel pump 2.

When the internal combustion engine is started up, approximate ambient pressure prevails in the common rail injection system 1 first. After the start of the high pressure pump 2, the pressure in the high pressure fuel accumulator 6 increases to the injection pressure $p_{inj}$ of 160 Mpa. Fuel 3 reaches the buffer store 10 via the throttle valve 11 until the predetermined return line pressure $p_{drain}$ is reached. The throttle valve 11 then closes. This enables the pressure difference Δp to build up very quickly.

Fuel reaching the buffer store 10 as a result of the leakage additionally increases the pressure in the buffer store 10. If a pressure difference Δp of 25 Mpa is reached, the pressure control valve 13 thus opens and the surplus fuel flows back to the high pressure pump 2.

Figure 2:
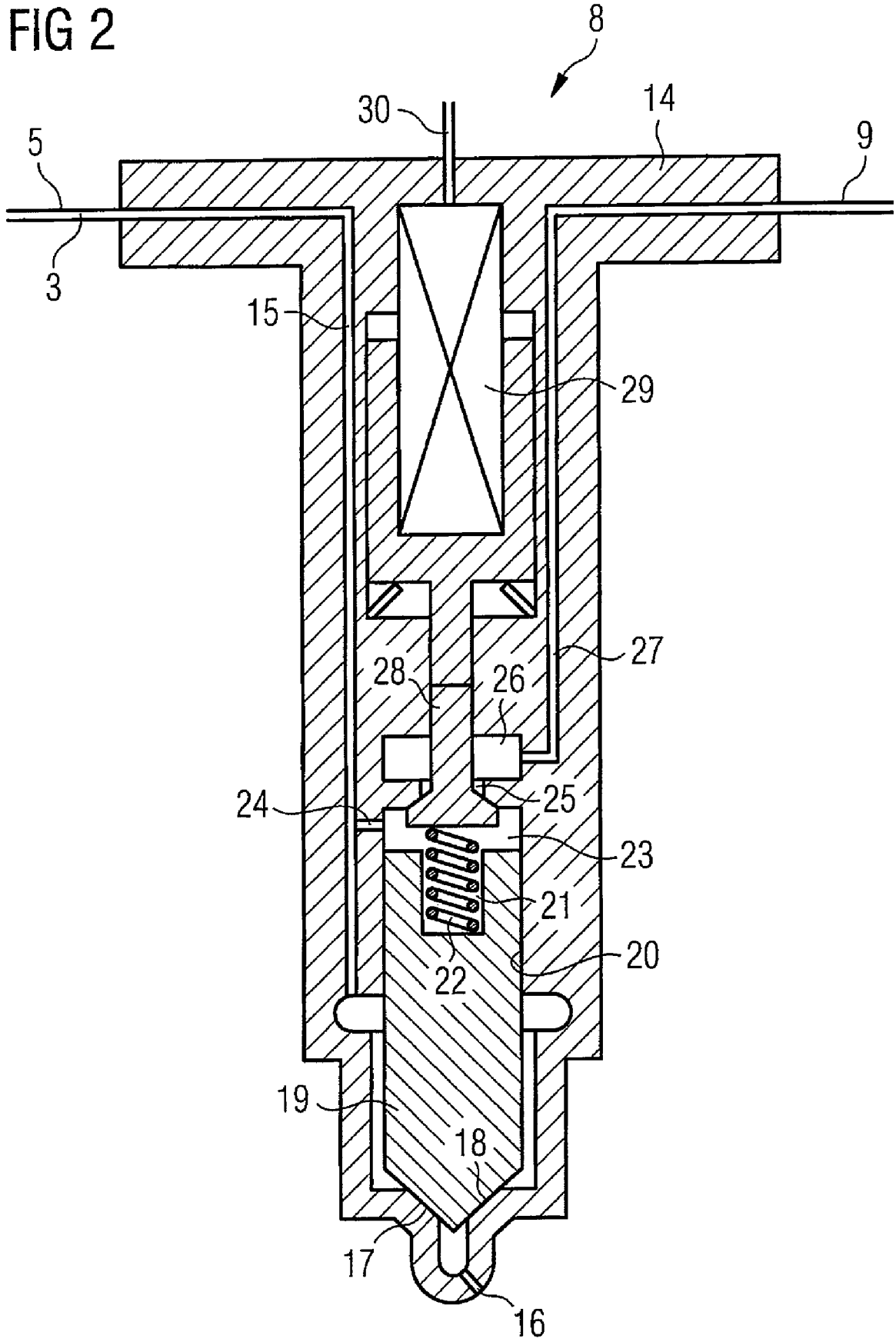
FIG. 2 shows a schematic diagram of an injector for a common rail injection system according to an embodiment.

FIG. 2 shows a schematic diagram of the injector 8 from FIG. 1. The fuel 3 flows through the fuel line 5 into an injector body 14. A supply channel 15 is formed in the injector body 14, through which supply channel the fuel 3 can reach an opening 16 in the injector body 14.

A valve seat 17 is embodied at the opening 16, said valve seat 17 interacting with a tip 18 of a control piston 19 to open and close the opening 16. If the tip 18 is located on the valve seat 17, no fuel can escape from the opening 16.

The control piston 19 operates in a recess 20 in the injector body. On the side opposite the tip 18, the control piston 19 includes a spring recess 21, in which a spring 22 is mounted. The spring 22 extends over the control piston 19 into the recess 20, which forms there a pressure chamber 23, which is connected to the supply channel 15 by way of a branch channel 24.

The pressure chamber 23 is connected to a leakage chamber 26 by way of a release channel 25, said leakage chamber 26 being connected in turn to the return line 9 by way of a leakage channel 27.

The pressure chamber 23 can be sealed against the leakage chamber 26 with the aid of a valve plunger 28. The valve plunger 28 can be activated by a piezo actuator 29, which can be connected to a controller (not illustrated here) by way of an electrical line 30.

The injector 8 functions here as follows: in the idle state, i.e. provided the piezo actuator 29 is not activated, the same fuel pressure is present in the pressure chamber 23 as is present in the fuel supply line 5 and the environment of the tip 18 of the control piston 19, namely the injection pressure $p_{inj}$.

If the piezo actuator, by virtue of an electrical signal, is activated in the electrical line 30, it elongates and thus pushes the valve plunger 28 against the spring force of the spring 22 in the direction of the control piston. The release channel 25 herewith opens so that fuel can escape from the pressure chamber 23 via the release channel 25 into the leakage chamber 26 and from there via the leakage channel 27 into the return line 9. The fuel pressure in the pressure chamber 23 herewith significantly reduces and the considerably higher fuel pressure prevailing in the environment of the tip 18 pushes the control piston 19 against the spring force of the spring 22 in the direction of the piezo actuator 29. The tip 18 herewith lifts from the valve seat 17 and releases the path for the fuel, which escapes through the opening 16 in the combustion chamber of the internal combustion engine (not illustrated here).

If the piezo actuator 29 is deactivated, it contracts to its original length and the valve plunger 28 seals the connection between the pressure chamber 23 and the leakage chamber 26. Fuel flows into the pressure chamber 23 through the branch channel 24, so that the same pressure forms there as prevails in the environment of the tip 18. As a result of the spring force of the spring 22, the control piston 19 is pushed onto the valve seat 17 with its tip 18, so that fuel can no longer escape through the opening 16.

The quantity of fuel flowing through the release channel 25 when the injector 8 is in the opened state is proportional here to the pressure difference Δp between the injection pressure $p_{inj}$, which is present in the fuel line 5 and the return line pressure $p_{drain}$ which is present in the return line 9. The response behavior of the injector, in particular its closing and opening time, can thus be adjusted by way of adjusting the pressure control valve 13 and consequently from the pressure difference Δp.

In an alternative embodiment, the injector is designed as a controllable throttle valve, which means that a throttle valve is arranged in the injector 8 in the leakage path from the pressure chamber 23 and leakage channel 27, said throttle valve is used as an adjusting means for adjusting the return line pressure $p_{drain}$. In this case, the pressure difference Δp between the injection pressure $p_{inj}$ and the return line pressure $p_{drain}$ depends on the leakage flow. The throttle valve is then controlled as a function of the leakage flow so that the desired pressure difference Δp is adjusted.

Figure 3:
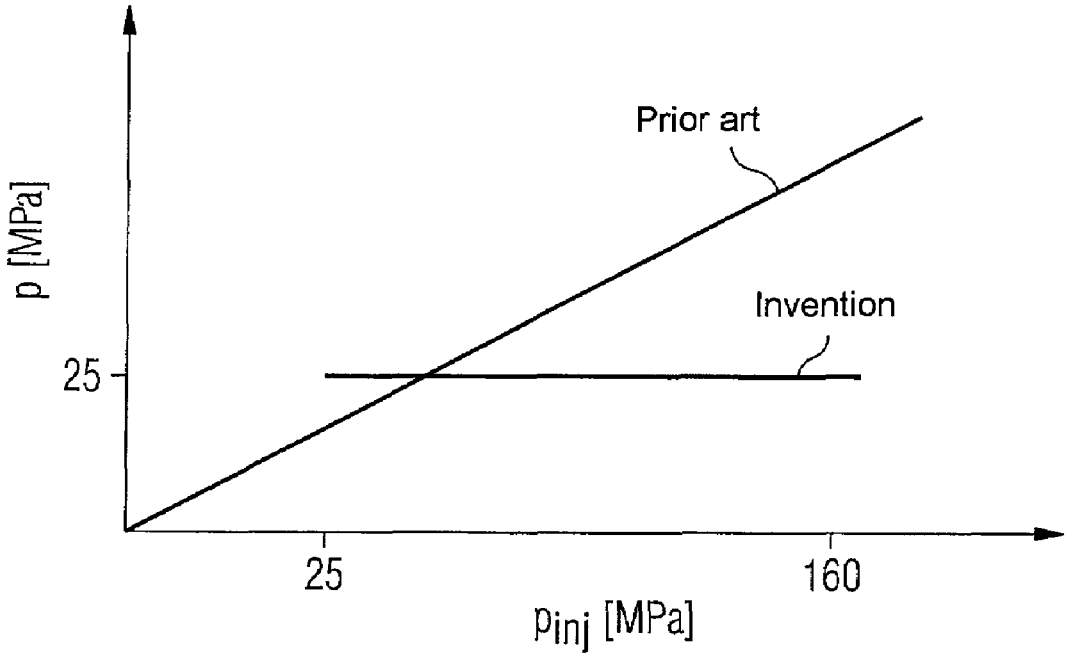
FIG. 3 shows a schematic diagram, in which the pressure difference Δp between the injection pressure $p_{inj}$ and the return line pressure $p_{drain}$ is plotted against the injection pressure $p_{inj}$ for a common rail injection system according to the prior art and a common rail injection system according to an embodiment.

FIG. 3 shows the pressure difference Δp plotted against the injection pressure $p_{inj}$ for a common rail injection system according to the prior art and a common rail injection system according to an embodiment. With conventional common rail injection systems, the pressure difference Δp increases with an increasing injection pressure $p_{inj}$. With a common rail injection system according to an embodiment, the pressure difference Δp contrastingly remains constant. It follows here that the opening and closing speed of the injector 8 does not essentially change with a varying injection pressure $p_{inj}$.

Figure 4:
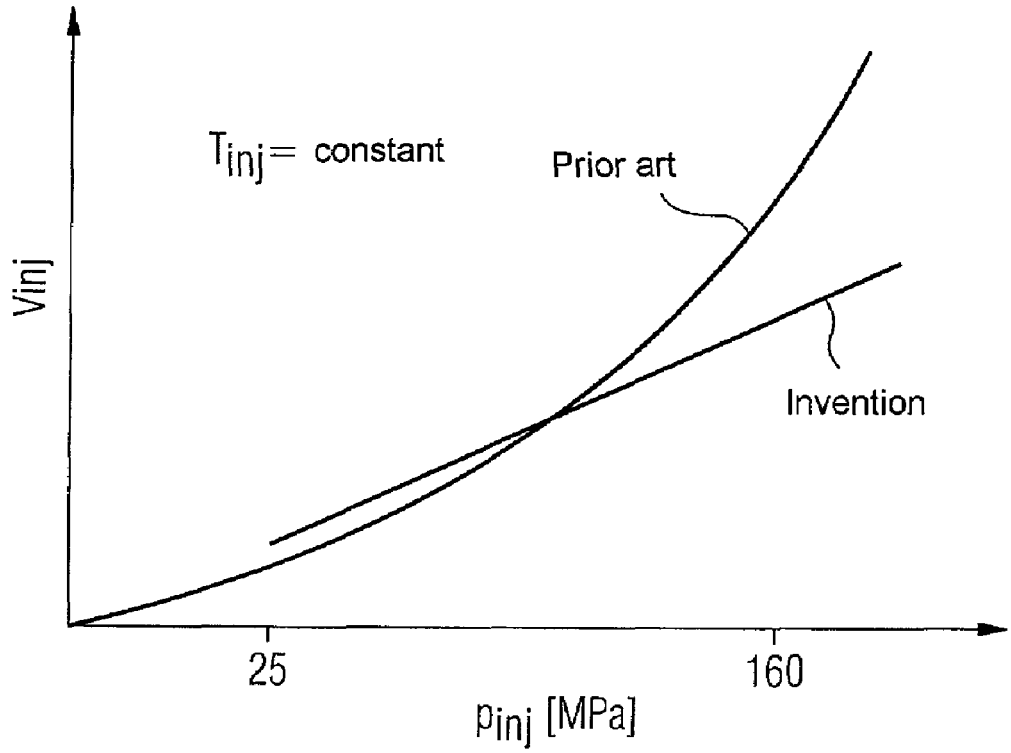
FIG. 4 shows a schematic diagram, in which the injection quantity of fuel with a constant opening time $T_{inj}$ of the injector is plotted against the injection pressure $p_{inj}$.

FIG. 4 shows the injection quantity $V_{inj}$ as a function of the injection pressure $p_{inj}$. With common rail injection systems according to the prior art, the injection quantity $v_{inj}$ increases disproportionately with a constant injection time $T_{inj}$. This is due to the fact that on the one hand the injector opens more quickly as a result of the increasing pressure difference and on the other hand the flow from the injector increases with an increasing injection pressure $p_{inj}$. With a common rail injection system according to an embodiment, the injection quantity $v_{inj}$ essentially increases with the injection pressure $p_{inj}$ in a linear fashion since the opening speed of the injector only depends on the pressure difference Δp, which is kept constant. With the same opening speed, the injection quantity depends as a first approximation on the pressure difference Δp.

What is claimed is:

1. A common rail injection system for an internal combustion engine having at least one combustion chamber, comprising:

a high pressure fuel pump for supplying fuel, a high pressure fuel accumulator connected to the high pressure fuel pump for storing injection-pressurized fuel in relation to the environment of the common rail injection system, an injector connected to the high pressure fuel accumulator for delivering fuel into the at least one combustion chamber, a throttle valve, a return line for returning fuel from the injector to the high pressure fuel pump said returning fuel being pressurized by a return line pressure in relation to the environment of the common rail injection system, a buffer store arranged in the return line, an adjusting means for adjusting the return line pressure and the buffer store pressure, and a direct connecting line, connecting the high pressure fuel accumulator and the buffer store, wherein the throttle valve is arranged in the direct connecting line between the high pressure fuel accumulator and the buffer store.

2. The common rail injection system according to claim 1, wherein the adjusting means comprises a pressure control valve behind the injector.

3. The common rail injection system according to claim 1, wherein the adjusting means comprises a pressure control valve behind the injector and the pressure control valve is arranged behind the buffer.

4. The common rail injection system according to claim 1, wherein the throttle valve bypasses the injector via the direct connecting line and is connected to the return line upstream of the adjusting means.

5. The common rail injection system according to claim 1, wherein the injector comprises a switching means for bringing the injector into an open position and a closed position, with the injector only delivering fuel into the combustion chamber when the switching means is in the open position.

6. The common rail injection system according to claim 5, wherein the switching means can be actuated by means of injection-pressurized fuel.

7. The common rail injection system according to claim 1, wherein the high pressure fuel pump comprises two compressor parts, with the first compressor part being connected to the buffer store and the high pressure fuel accumulator and the second compressor part being connected to the fuel tank.

8. An internal combustion engine comprising a common rail injection system comprising:

a high pressure fuel pump for supplying fuel, a high pressure fuel accumulator connected to the high pressure fuel pump for storing injection-pressurized fuel in relation to the environment of the common rail injection system, an injector connected to the high pressure fuel accumulator for delivering fuel into the at least one combustion chamber, a throttle valve, a return line for returning fuel from the injector to the high pressure fuel pump said returning fuel being pressurized by a return line pressure in relation to the environment of the common rail injection system, a buffer store arranged in the return line, and an adjusting means for adjusting the return line pressure and the buffer store pressure, and a direct connecting line, connecting the high pressure fuel accumulator and the buffer store, wherein the throttle valve is arranged in the direct connecting line between the high pressure fuel accumulator and the buffer store.

9. The internal combustion engine according to claim 8, wherein the adjusting means comprises a pressure control valve behind the injector.

10. The internal combustion engine according to claim 8, wherein the adjusting means comprises a pressure control valve behind the injector and the pressure control valve is arranged behind the buffer.

11. The internal combustion engine according to claim 8, wherein the throttle valve bypasses the injector via the direct connecting line and is connected to the return line upstream of the adjusting means.

12. The internal combustion engine according to claim 8, wherein the injector comprises a switching means for bringing the injector into an open position and a closed position, with the injector only delivering fuel into the combustion chamber when the switching means is in the open position.

13. The common rail injection system according to claim 12, wherein the switching means can be actuated by means of injection-pressurized fuel.

14. The common rail injection system according to claim 8, wherein the high pressure fuel pump comprises two compressor parts, with the first compressor part being connected to the buffer store and the high pressure fuel accumulator and the second compressor part being connected to the fuel tank.

15. A method of using of a pressure control in the fuel leakage flow feedback system of an internal combustion engine, comprising the steps of supplying fuel by a high pressure fuel pump, storing injection-pressurized fuel in relation to the environment of the common rail injection system by a high pressure fuel accumulator connected to the high pressure fuel pump, delivering fuel into the at least one combustion chamber by an injector connected to the high pressure fuel accumulator, returning fuel from the injector to the high pressure fuel pump, said returning fuel being pressurized by a return line pressure in relation to the environment of the common rail injection system, and adjusting the return line pressure, storing fuel in a buffer store of the return line, and passing fuel from the high pressure fuel accumulator to the buffer store via a direct connecting line and adjusting a pressure difference between the high pressure fuel accumulator and the buffer store via a throttle valve in the direct connecting line.

16. The method according to claim 15, further comprising the step of bringing the injector into an open position and a closed position, wherein the injector only delivering fuel into the combustion chamber when the switching means is in the open position.

17. The method according to claim 15, wherein the switching is performed by injection-pressurized fuel.

* * * * *